US010112318B2

(12) United States Patent
Jean et al.

(10) Patent No.: US 10,112,318 B2
(45) Date of Patent: Oct. 30, 2018

(54) PRESSING ASSEMBLY AND A METHOD FOR FORMING A DEPRESSION WITHIN A MOVING, WET GYPSUM BOARD

(71) Applicant: Saint-Gobain Placo SAS, Suresnes (FR)

(72) Inventors: Remi Jean, Avignon (FR); Jean-Louis Mongrolle, Bassens (FR); Dariusz Drag, Pinczow (PL); Richard Morlat, Les Pavillons sous Bois (FR)

(73) Assignee: Saint-Gobain Placo SAS (FR)

( * ) Notice: Subject to any disclaimer, the term of this patent is extended or adjusted under 35 U.S.C. 154(b) by 549 days.

(21) Appl. No.: 14/365,412

(22) PCT Filed: Dec. 13, 2012

(86) PCT No.: PCT/EP2012/075380
§ 371 (c)(1),
(2) Date: Jun. 13, 2014

(87) PCT Pub. No.: WO2013/087766
PCT Pub. Date: Jun. 20, 2013

(65) Prior Publication Data

US 2014/0374955 A1 Dec. 25, 2014

(30) Foreign Application Priority Data

Dec. 15, 2011 (EP) ..... 11290582
Jul. 23, 2012 (EP) ..... 12290248

(51) Int. Cl.
*B28B 11/08* (2006.01)
*B28B 17/02* (2006.01)
(Continued)

(52) U.S. Cl.
CPC ..... *B28B 11/0863* (2013.01); *B28B 11/10* (2013.01); *B28B 17/023* (2013.01); *B28B 19/0092* (2013.01)

(58) Field of Classification Search
CPC ..... B28B 11/0863; B28B 17/023; B28B 19/0092; B28B 11/10
See application file for complete search history.

(56) References Cited

U.S. PATENT DOCUMENTS 1,754,429 A * 4/1930 Knode ..... B28B 5/027 156/39
2,238,017 A 4/1941 Duncan
5,198,052 A * 3/1993 Ali ..... B28B 11/08 156/209

FOREIGN PATENT DOCUMENTS

CN 2490248 5/2002
EP 0482810 A1 4/1992
(Continued)

*Primary Examiner* — Robert J Grun
(74) *Attorney, Agent, or Firm* — GrayRobinson, P.A.; Michael J. Colitz, III

(57) ABSTRACT

A pressing assembly (10) and a method for forming a depression (105) within a moving, wet gypsum board (100) is disclosed. The assembly comprises a pressing head (16) comprising a pressing surface which is arranged to contact the board, and a support member (17), the pressing head (16) being arranged to compress a portion of the board between the pressing surface and the support member (17) to form a depression (105) within the board (10). The pressing surface comprises a first and second surface portion (24, 25) separated by a relief portion (27), which is arranged to press the board (100) toward the support head (17) with less compressive force than the first and second surface portion (24, 25). The assembly further comprises drive means (18, 19, 22) for moving the pressing head and the support member in a first direction which substantially corresponds with the
(Continued)

direction of the moving board, and a second direction which is substantially perpendicular to a plane of the board, while the speed of the pressing assembly in the first direction substantially matches the speed of the board.

13 Claims, 9 Drawing Sheets

(51) Int. Cl.
*B28B 11/10* (2006.01)
*B28B 19/00* (2006.01)

(56) References Cited

FOREIGN PATENT DOCUMENTS

| | | | |
|---|---|---|---|
| EP | 0957070 | A1 | 11/1999 |
| WO | 20110020146 | A1 | 2/2011 |

* cited by examiner

PRESSING ASSEMBLY AND A METHOD FOR FORMING A DEPRESSION WITHIN A MOVING, WET GYPSUM BOARD

The present invention relates to a pressing assembly and a method for forming a depression within a board, and particularly, but not exclusively, to a pressing assembly and a method for forming a depression within a moving, wet gypsum based board.

A gypsum plasterboard or wall board comprises an inner layer of gypsum (calcium sulphate dihydrate form) sandwiched between two outer layers of lining paper. Gypsum board is produced by feeding calcined gypsum (hemihydrate form), also known as stucco, into a continuous mixer with water and additives. The slurry produced is then placed between continuous layers of lining paper and passed through an extrusion system that compresses it to the desired thickness. As this continuous wet plasterboard moves along the conveyor line the calcium sulfate hemihydrate rehydrates to its original dihydrate form. The wet plasterboard is initially soft but then board core quickly sets and therefore hardens. The paper becomes chemically and mechanically bonded to the board core. Then the plasterboard is cut to length and dried to drive off the excess water content to produce a rigid drywall.

Plasterboards are typically used to line walls and ceilings, and are secured to walls and ceilings in a side-by-side relation. The joint between the boards is typically covered with a mesh tape and a jointing compound is then applied to the arrangement of boards to cover the joints therebetween and thus provide a smooth finish. This obviates the requirement to plaster the entire board, or to have a large joint. However to reduce the finishing time and quantity of finishing plaster used to obtain a smooth finish, plasterboards are also formed with a longitudinal tapered edge such that the mesh tape is applied at the tapered region and the tapered region is then filled to cover the joints.

In order to form this taper, it is necessary to compress the gypsum with a pressing device, but this must be performed once the wet gypsum layer has partially set, to prevent the lining from becoming detached from the gypsum and to ensure that the partially set gypsum can retain the pressed shape. EP0482810 discloses that to avoid a lateral shift in the gypsum during compression, the gypsum must be set to a minimum point before the pressure can be successfully applied. The setting must reach the point where the core has attained a sufficient degree of stiffness to allow compression without the gypsum mass moving laterally.

The reshaping of the gypsum layer to create the taper, is generally performed by compressing the gypsum layer from the underside thereof, and this is typically performed at a position along the production line which corresponds to a specified time in the hydration cycle of the gypsum layer. Reshaping the layer early in the hydration cycle has the advantage of lowering the force required to compress, namely densify the gypsum, however, the reduced viscosity of the gypsum early in the hydration cycle and the formation of the taper depression in the underside of the layer, reduces the ability of the compressed gypsum to retain the compressed shape. In particular, the gypsum layer may tend to sag after the reshaping operation, such that a depression is formed in the upper side of the gypsum layer (that is, opposite the region of application of the compressive force). Conversely, reshaping the gypsum layer later in the hydration cycle, increases the force required to compress, namely densify the layer, but enables the compressed layer to retain the desired shape. EP0482810 discloses that the reshaping is best performed later in the hydration cycle.

In accordance with the present invention as seen from a first aspect, there is provided a pressing assembly for forming a depression within a moving, wet gypsum board, the assembly comprising a pressing head comprising a pressing surface which is arranged to contact the board, and a support member, the pressing head being arranged to compress a portion of the board between the pressing surface and the support member to form a depression within the board, the assembly further comprising drive means for moving the pressing head and the support member in a first direction which substantially corresponds with the direction of the moving board, and a second direction which is substantially perpendicular to a plane of the board, wherein, the pressing surface comprises a first surface portion and a second surface portion, the first and second surface portions being separated by a relief portion and being arranged to press the board toward the support head with a compressive force that is greater than any compressive force exerted on the board by the relief portion.

Preferably, the pressing surface is arranged so that the relief portion does not exert any compressive force on the board. In general, the relief portion comprises a trough. Typically the trough extends across the pressing surface.

Advantageously, the pressing assembly minimises any lateral shift in the lining material relative to the gypsum core by compressing the board while moving with minimal relative speed to the board. In addition, the movement of the pressing head substantially perpendicular to the plane of the board, as opposed to along the board, further helps minimise the development of ridges and raised portions around the depression.

The relief portion further provides for a less densified region of the board disposed between the two more densified regions. The less densified region serves as a support for the taper formed by the first and second surface portion either side thereof, and thus minimises the recovery of the reshaped board to its original shape. In particular, the relief portion may help to avoid sagging of the board after the reshaping operation. That is, it may help to prevent the later formation of a depression in the surface of the board opposite the region at which the pressing assembly contacts the board. Accordingly, the assembly of the present invention enables the board to be compressed early during the hydration cycle and thus facilitates a reduction in the required compressive force.

In addition, it is found that the less densified portion facilitates an easier cutting of the board compared to the more densified regions, prolongs the life of the cutting blade and further minimises any snagging of the blade during the cutting operation.

Preferably, the drive means is arranged to accelerate the pressing head and the support member in the first direction to a speed which substantially matches a speed of the moving board. The drive means is preferably arranged to move the pressing head toward the support member to form a depression within the board, when the speed of the pressing head and the support member in the first direction substantially matches the speed of the moving board.

The pressing surface is preferably arranged to extend along a width of the board, such that the depression is arranged to extend across the board.

Preferably, the relief portion has an elongate shape. Typically, the relief portion extends from one region of the perimeter of the pressing surface to another region of the perimeter of the pressing surface. Preferably, the pressing surface is arranged such that when the pressing surface is pressed against the gypsum board, the orientation of the relief portion corresponds to a lateral direction of the board.

Preferably, the first and second surface portions extend in an outward direction of the pressing head as they each approach the relief portion. Effectively, therefore, the first and second surface portions provide the pressing surface with a generally convex shape.

Preferably, the first and second surface portions each comprise a planar surface.

The pressing surface is preferably disposed upon a die, which may be detachably coupled to the pressing head or formed integrally therewith. The relief portion is preferably arranged to extend across the width of the board and preferably comprises an aperture disposed in the die or a recess formed therein.

In accordance with the present invention as seen from a second aspect there is provided a method for forming a depression within a moving, wet gypsum board, the method comprising the use of a pressing assembly, the method comprising the steps of providing a gypsum board;

moving the pressing assembly in the direction of travel of the board, such that the speed of the pressing assembly in the direction of travel of the board substantially matches the speed of the board, while simultaneously causing the pressing assembly to move towards the board, to bring the pressing assembly into contact with a portion of the board; and causing the pressing head to compress the board to substantially simultaneously form a first depression and a second depression, the first and second depressions being located either side of a comparatively uncompressed board portion.

The method typically further comprises the preliminary step of causing the pressing assembly to accelerate to the speed of the board. Typically the method further comprises the step, after the step of causing the pressing head to compress the board, of decelerating the pressing assembly.

Typically, the pressing assembly travels from an initial stationary position to a final stationary position. In general, the pressing assembly is arranged to return to the initial stationary position after reaching the final stationary position.

The method preferably further comprises comparing the speed of the pressing assembly in the direction of travel of the board to the speed of the moving board and adjusting the speed of the pressing assembly in dependence of the difference therebetween.

Typically, the speed of the pressing assembly in the direction of travel of the board is matched to the speed of the board by means of a Hoekens linkage or by a hypotrochoid motion.

The step of causing the pressing head to contact and compress the board is typically carried out when at least 10% of the gypsum hydration has occurred, preferably when at least 40% of the gypsum hydration has occurred, more preferably when at least 60% of the gypsum hydration has occurred.

Typically the gypsum board comprises silicone oil. Preferably, the oil is present in an amount greater than 100 g/m$^3$, more preferably greater than 200 g/m$^3$. Preferably, the oil is present in an amount less than 6000 g/m$^3$, more preferably less than 800 g/m$^3$, most preferably less than 400 g/m$^3$.

For reference, the weight of the board as a whole is typically below 960 kg/m$^3$, and generally in the range between 480 and 720 kg/m$^3$.

It has been observed that the presence of silicone oil may help to increase the depth of first and second depressions produced through the method of the present invention. Additionally, the presence of silicone oil may help to inhibit the formation of blisters between the gypsum core and any liner provided on the surface of the gypsum board. It is thought that these effects may be due to the increased deformability of the gypsum, arising from the presence of the silicone oil.

Silicone oil is known for use as a water repellent in gypsum boards. Surprisingly, however, it has been found that the effect of increasing the depth of the depressions and/or reducing the incidence of blistering may be achieved using levels of silicone oil that are significantly lower than those required to provide a water-repellent effect.

That is, in order to provide a water-repellent board, silicone must typically be present in an amount greater than 1440 g/m$^3$, more generally in the range of 2400-4800 g/m$^3$. By contrast, much lower amounts of silicone oil are required to increase the depth of depressions and/or reduce blistering. For example, these effects may be achieved using silicone oil in amounts of just 320 g/m$^3$, or even lower.

Further preferred features of the method according to the second aspect, may comprise one or more of the features of the pressing assembly of the first aspect.

The invention will now be described by way of example only with reference to the accompanying Figures, in which.

Figure 3:
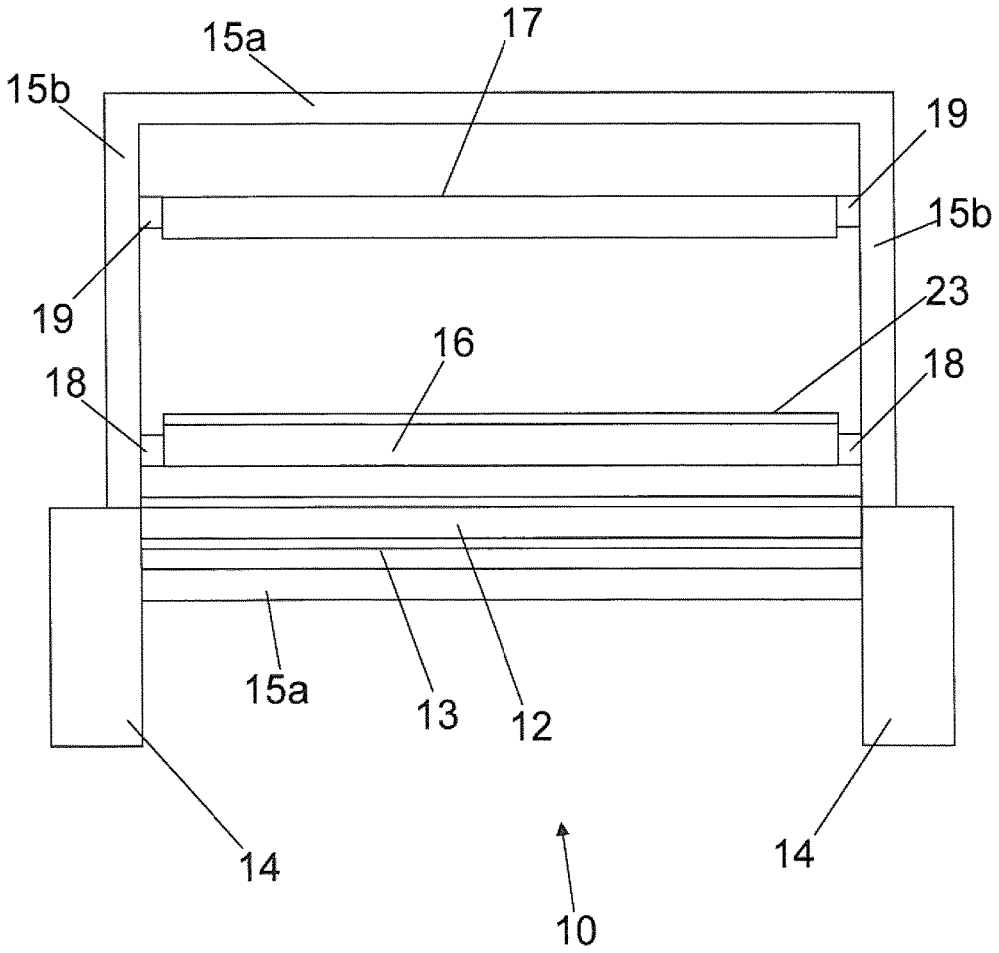
FIG. 3 is a front view of the pressing assembly illustrated in FIG. 1.
Figure 4:
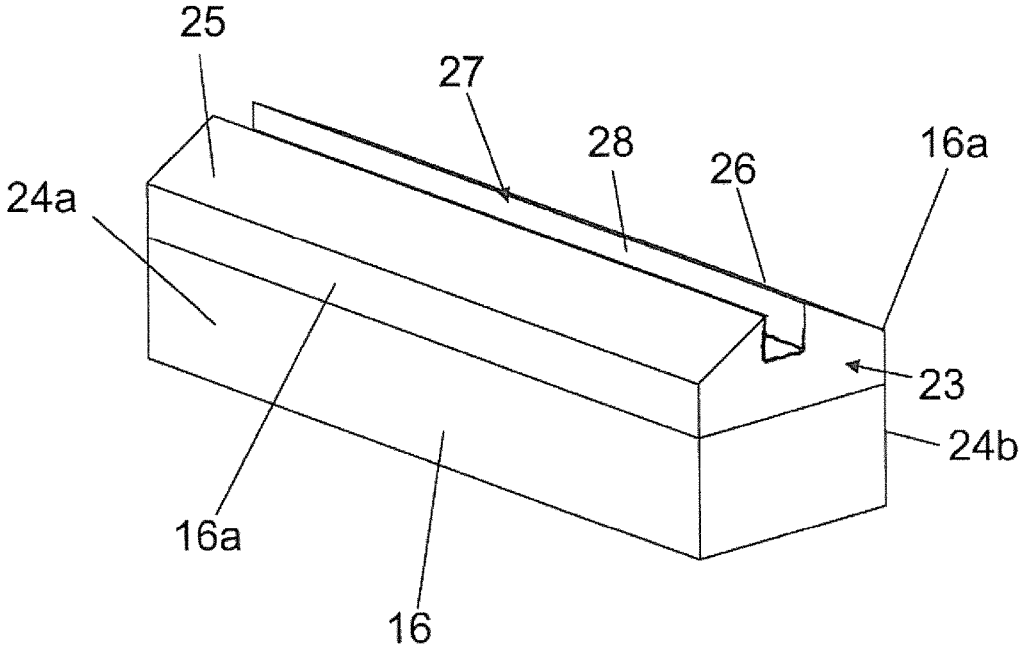
FIG. 4 is a magnified view of the die disposed upon the pressing head.
Figure 5:
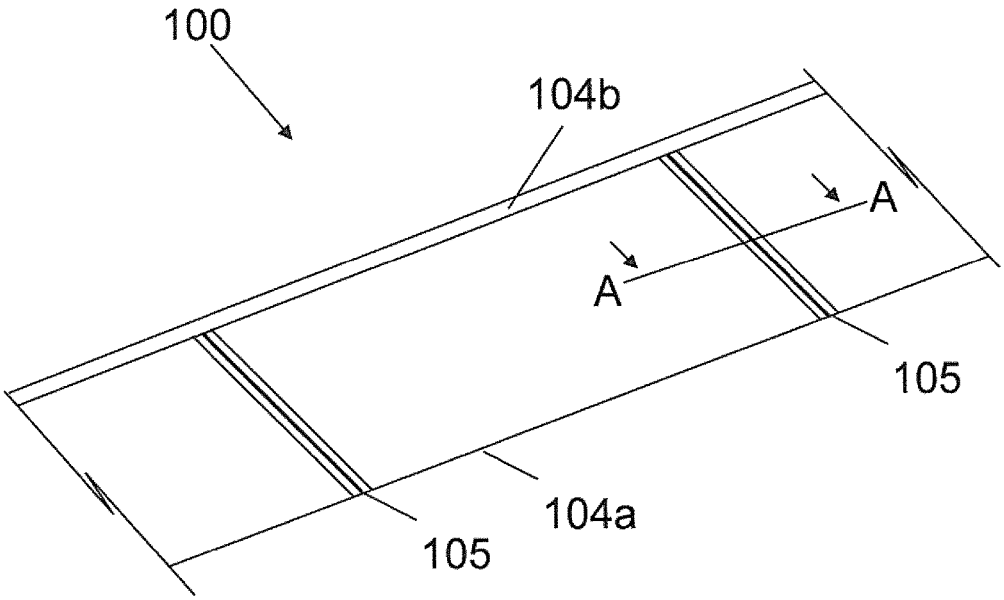
FIG. 5 is a perspective view of a continuous board.
Figure 6:
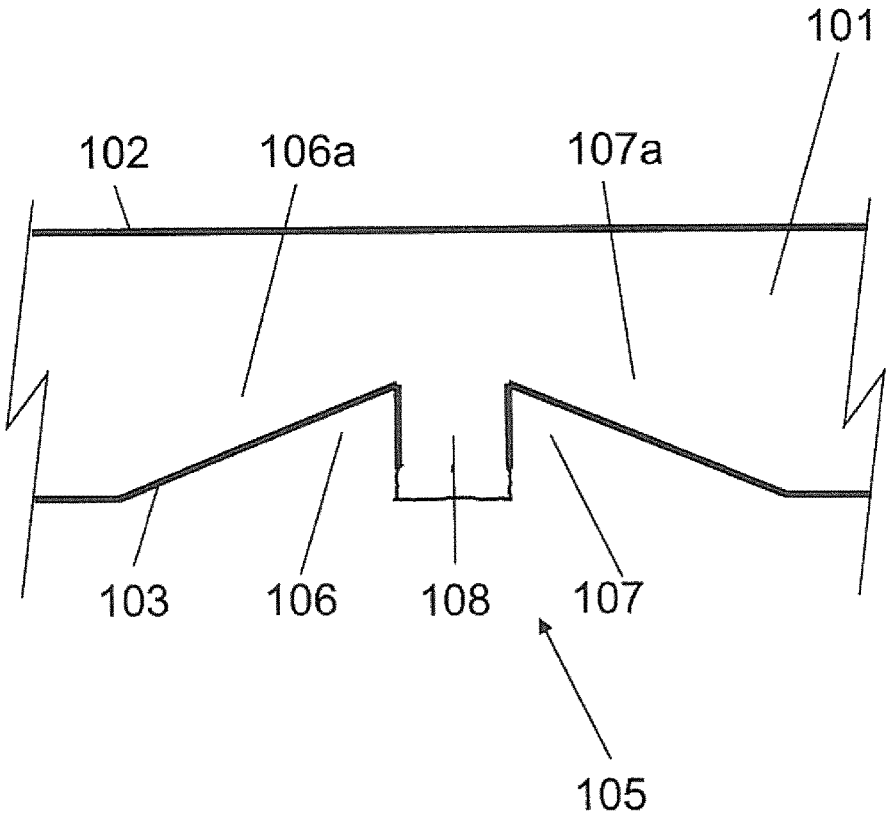
FIG. 6 is a magnified longitudinal sectional view taken along line A-A of FIG. 5, across a depression created by the pressing assembly according to an embodiment of the present invention.

Referring to FIGS. 1 to 4 of the drawings, there is illustrated a pressing assembly 10 according to an embodiment of the present invention for forming a depression 105 within a wet gypsum board 100 as illustrated in FIGS. 5 and 6 of the drawings, as the board 100 moves along a production line. The continuous board 100 comprises a layer of wet gypsum 101 disposed between a first and second liner material 102, 103. The liners 102, 103 are folded over each other along longitudinal side edges thereof to define longitudinal side edges 104*a*, 104*b* of the board 100 and to prevent the gypsum 101 from passing out from between the liners 102, 103. The pressing assembly 10 is disposed within the production line and the board 100 is supported upon a bed of rollers (not shown) disposed either side of the assembly 10. The board 100 is driven through the assembly 10 in a direction which is substantially parallel to the longitudinal side edges 104*a*, 104*b* of the board 100, at a substantially constant speed by a roller platform 11. The roller platform 11 comprises a substantially rectangular roller frame 12 having a plurality of rollers 13 which extend across the frame 12 between opposite longitudinal roller frame members 12*a*, and which is held in a substantially horizontal configuration, substantially level with the bed of rollers (not shown), by a plurality of frame legs 14.

Figure 7:
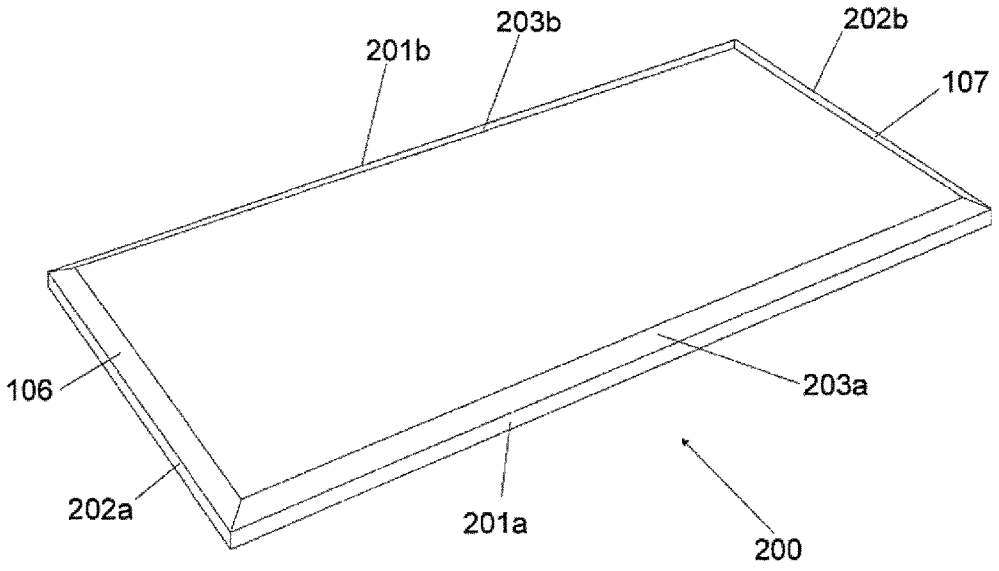
FIG. 7 is a perspective view of a board sheet.

The pressing assembly 10 is arranged to form a depression 105 within the board 100 at periodic intervals along the length thereof as the board 100 passes through the pressing assembly 10. The depressions 105 are arranged to extend substantially across the board 100, in a direction which is substantially transverse to the longitudinal side edges 104 of the board 100; however, the skilled reader will recognise the depressions 105 may be formed across the board at an alternative angle to the longitudinal side edges 104. The continuous board 100 is then cut across the board 100 within the depressions 105 to form a board sheet 200 as illustrated in FIG. 7 of the drawings. The longitudinal side edges of the board sheet 200 each have a first portion 201*a*, 201*b* that is perpendicular to the faces of the board sheet, and a second portion 203*a*, 203*b* that is oriented at an oblique angle to the faces of the board sheet. Lateral side edges extend substantially transverse to the longitudinal side edges 201, 201*b*, and similarly have a first portion 202*a*, 202*b* that is perpendicular to the faces of the board sheet, and a second portion 106, 107 that is oriented at an oblique angle to the faces of the board sheet. Thus, the board sheet 200 has tapered edges extending around its entire perimeter.

Figure 1:
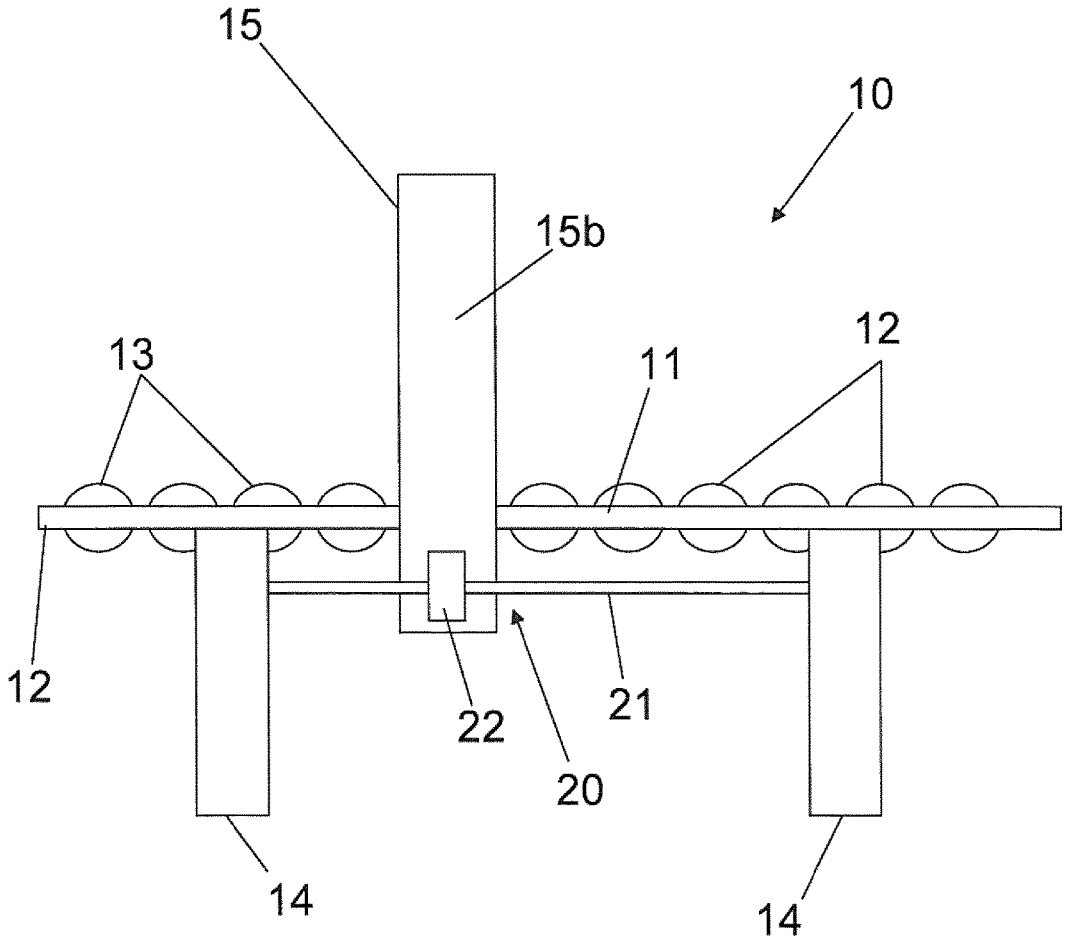
FIG. 1 is a side view of a pressing assembly according to an embodiment of the present invention, disposed within a gypsum board production line.
Figure 2:
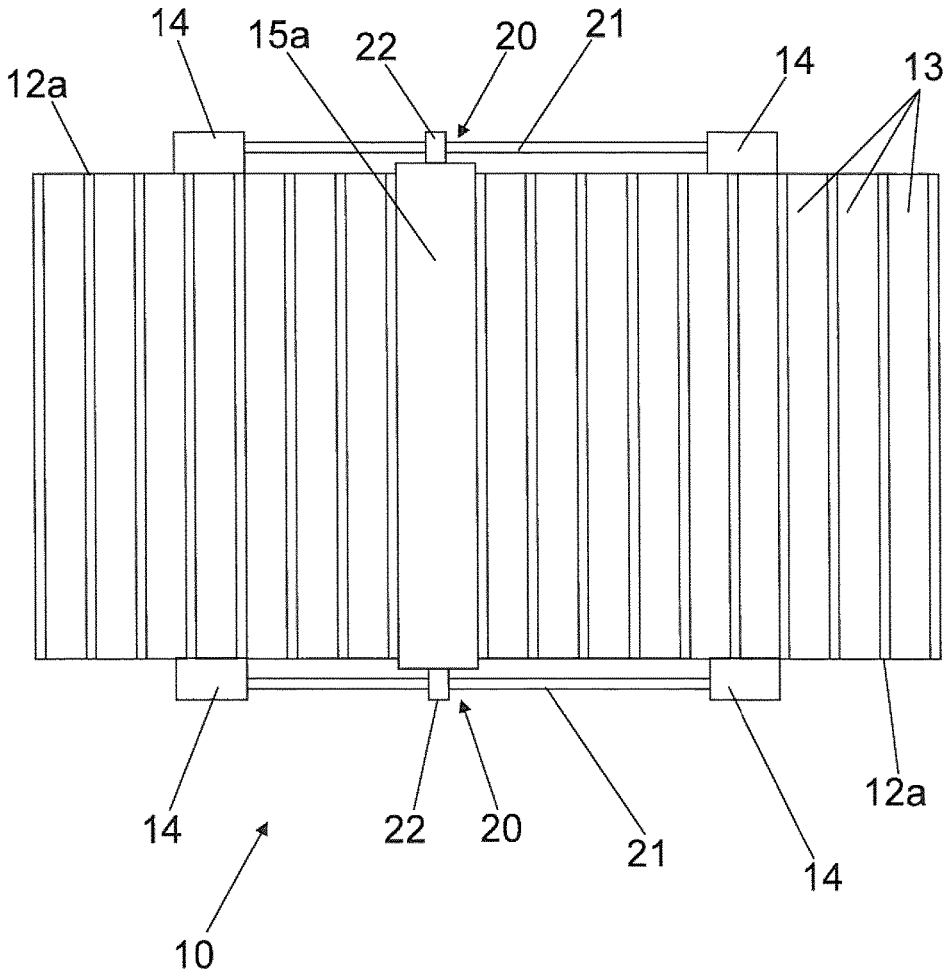
FIG. 2 is a plan view of the pressing assembly illustrated in FIG. 1.

Referring to FIGS. 1 to 3 of the drawings, the assembly 10 comprises a support frame 15 for supporting a pressing head 16 and a support member 17. The support frame 15 is substantially rectangular in shape and comprises opposite longitudinal 15*a* and lateral side members 15*b*, the latter of which are arranged to extend substantially perpendicular to the roller platform 11 and thus the plane of the board 100. In contrast, longitudinal side members 15*a* of the support frame are arranged to extend in a plane substantially parallel to the roller platform, in a direction which is substantially transverse to the longitudinal roller frame members 12*a*. The pressing head 16 and support member 17 are arranged to extend across the width of the support frame 15, between lateral side members 15*b*, and are orientated substantially parallel to a plane of the board 100.

The pressing head 16 comprises a first drive unit 18 disposed at each longitudinal end thereof, which are arranged to drive the head 16 along the lateral side members 15*b* within the frame 15. The support member 17 comprises a second drive unit 19 disposed at each longitudinal end thereof which are arranged to similarly drive the member 17 along the lateral side members 15*b* within the frame 15. The first and second drive units 18, 19 thus enable the separation of the pressing head 16 and the support member 17 and thus their separation from the board 100, which is arranged to pass therebetween, to be varied.

The support frame 15 is itself held in a fixed orientation upon the roller platform 11 with respect to the board, by a drive arrangement 20 which is arranged to drive the support frame 15 along the board 100 substantially parallel to the direction of travel of the board 100. The arrangement 20 comprises two support poles 21, one of which extends through each lateral side member 15*b* of the support frame 15, and are separately coupled at each end thereof to a pair of frame legs 14. The arrangement 20 further comprises a third drive unit 22 disposed upon each lateral side member 15*b* for driving the support frame 15 back and forth along the support poles 21. In this respect, the support poles 21 enable the pressing head 16 and support member 17 to move in a first direction which is substantially along the board 100, substantially parallel to the direction of travel of the board 100, whereas the lateral side members 15*b* enable the pressing head 16 and support member 17 to move in a second direction which is substantially perpendicular to the plane of the board 100.

The assembly 10 further comprises one or more sensors (not shown) associated therewith for sensing the speed of travel of the board 100. The sensors are arranged to output a signal which is input to the first, second and third drive units 18, 19, 22, to affect the speed at which the pressing head 16 and support member 17 become driven along the support frame 15 and the support poles 21.

The pressing head 16 is illustrated in the drawings as being disposed substantially below the board 100 and thus the support member 17, however, the skilled reader will recognise that this arrangement may be reversed with the pressing head 16 disposed above the board 100 and thus the support member 17. Referring to FIG. 4 of the drawings, the side of the pressing head 16 disposed adjacent the board 100 comprises a die 23 which may be detachably coupled thereto or which may be formed integrally therewith. The die 23 extends between opposite longitudinal ends of the pressing head 16, and is arranged to extend across the width of the board 100.

The die 23 comprises a first and second longitudinal side edge 24*a*, 24*b*, which are arranged to extend across the board, and from which extend a first and second substantially planar pressing surface 25, 26, respectively. The first surface 25 is inclined with respect to the direction of travel of the board 100 and the second surface 26 is declined with respect to the direction of travel of the board 100, such that the first and second pressing surfaces 25, 26 converge in a direction which is away from the pressing head 16 and the respective longitudinal side edges 24*a*, 24*b* of the die 23, toward a relief portion 27 disposed substantially centrally of the die 23. In this respect, the first and second surface portions 25, 26 are arranged to create opposed tapers 106, 107 within the gypsum board 100. The relief portion 27 is arranged to extend along the length of the die 23 and may comprise an aperture (not shown) disposed therein, or a recess 28, as illustrated in FIG. 4 of the drawings.

Figure 8:
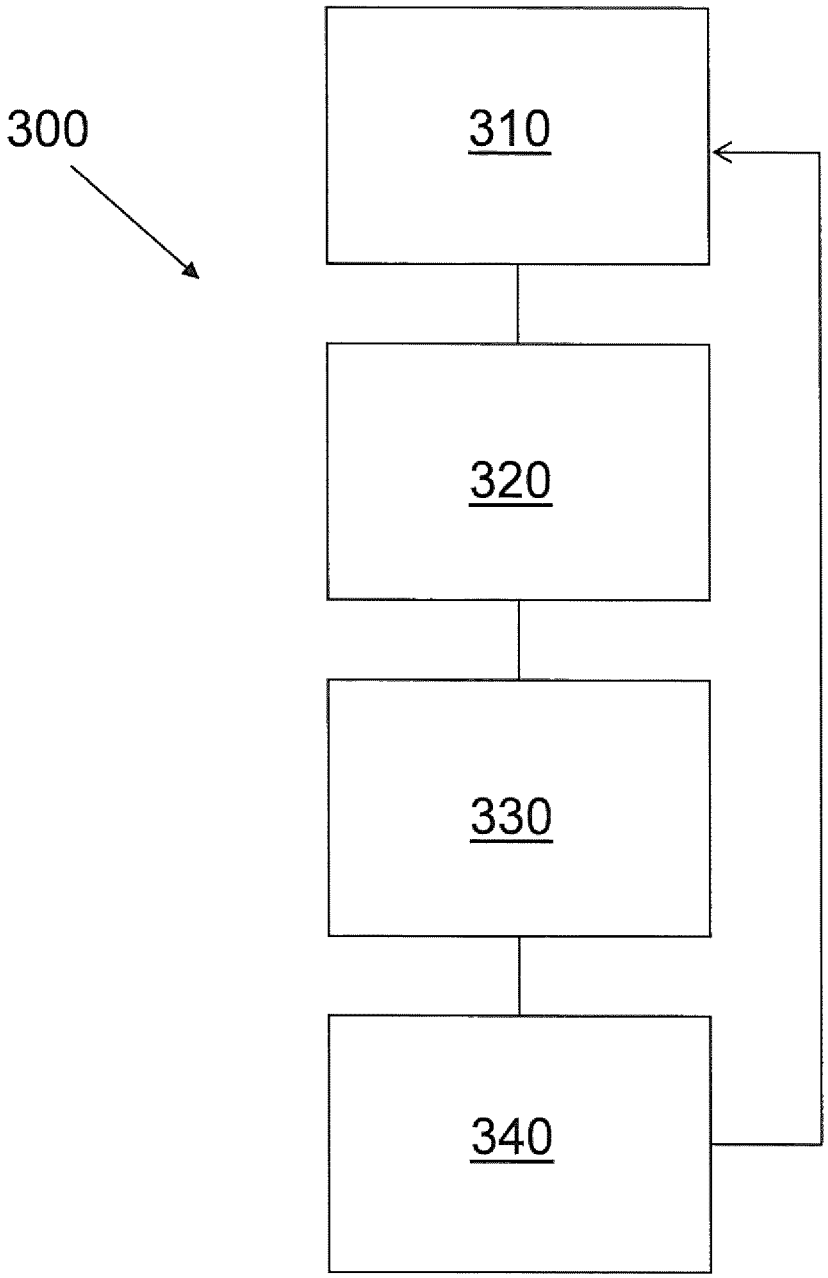
FIG. 8 is a flow chart of the steps associated with a method of forming a depression within a moving, wet gypsum board according to an embodiment of the present invention.

Referring to FIG. 8 of the drawings there is illustrated a method 300 according to an embodiment of the present invention. During use, the board 100 is driven through the assembly 10 by the rollers 13 disposed upon the roller platform 11, between the pressing head 16 and the support member 17, at constant speed. The support member 17 and pressing head 16 are subsequently accelerated at step 310, from a first stationary position, along the first direction by the third drive units 22, along the support poles 21, to a speed which substantially matches the speed of the board 100 through the assembly 10. This speed is monitored by comparing the relative speed between the board 100, and the pressing head 16 and support member 17, as determined using the sensors (not shown). The pressing head 16 and support member 17 are simultaneously driven at step 310 along the lateral side members 15*b* of the support frame 15, by the first and second drive units 18, 19, to a position adjacent an upper and lower face of the board 100, respectively.

When the speed of the pressing head 16 and support member 17 in the first direction substantially matches the speed of the board 100, namely when relative speed is within substantially ±0.1% of the board speed, the first and second drive units 18, 19 are arranged to drive the support member 17 and the pressing head 16 toward each other at step 320, to compress the board 100 along the width thereof and thus form a depression 105 within the wet gypsum. The support member 17 is arranged to resist the upward force from the pressing head 16 and presents a sufficiently smooth and large surface compared with the face of the die 23, to avoid forming a depression (not shown) on the upper surface of the board 100.

The first drive units 18 disposed on the pressing head 16 are arranged to control the speed at which the pressing head 16 is driven in and out of the board 100 and permit a controlled steady pressing in phase, a short constant press and a withdrawal. Moreover, the compressing of the board 100 while maintaining minimal relative speed between the board 100 and the pressing head 16 minimises the accumulation of wet gypsum either side of the depression 105, which would otherwise present an undesirable bulge or protuberance in the dried board.

As the board 100 is compressed, the wet gypsum 101 disposed between the liners 102, 103 becomes compressed between the pressing surfaces of the die 23 and the support member 17. The first and second pressing surfaces 25, 26 are arranged so that the recess 28 does not exert any compressive force on the board. Thus, the resulting longitudinal sectional shape of the board 100, as illustrated in FIG. 6 of the drawings comprises first and second opposed taper regions 106, 107 which extend into the board 100, toward an uncompressed, raised support step 108. The portion of gypsum disposed within the raised step 108 is therefore less densified than the portion of the board 106*a*, 107*a* disposed either side thereof.

The depth to which the die 23 is arranged to press into the board 100 may be varied by monitoring the force applied to the board 100 using a force sensor (not shown), for example, or by monitoring a fixed position upon the pressing head 16 with respect to a reference position upon the assembly 10, for example. Once the board 100 has been compressed to form the opposed tapers 106, 107 either side of the support step 108, the separation of the pressing head 16 and the support member 17 is then increased and the pressing head 16 and support member 17 are decelerated in the first direction to a second stationary position at step 330. The pressing head 16 and support member 17 are then driven in a second direction at step 340 back along the support poles 21 from the second position to the first position for subsequent pressing of the board 100. The cycling of the pressing head 16 and the support member 17 from the first position to the second position and back to the first position is controlled to ensure that the depressions 105 are formed at equally spaced positions on the board 100, namely within ±2 mm. This ensures that the resulting boards 200 which are formed by cutting along the central portion of the depressions 105 comprise substantially the same length.

The boards 200 are formed by cutting the board 100 with a cutting blade (not shown) along the less densified portion of the board within the depressions. The less densified portions enable the continuous board 100 to be cut more easily than if the continuous board 100 was cut along a densified portion, prolong the life of the cutting blade (not shown) and minimise an snagging of the blade (not shown) on the board 100 which may otherwise tear the liners 102, 103 of the board 100.

Figure 9:
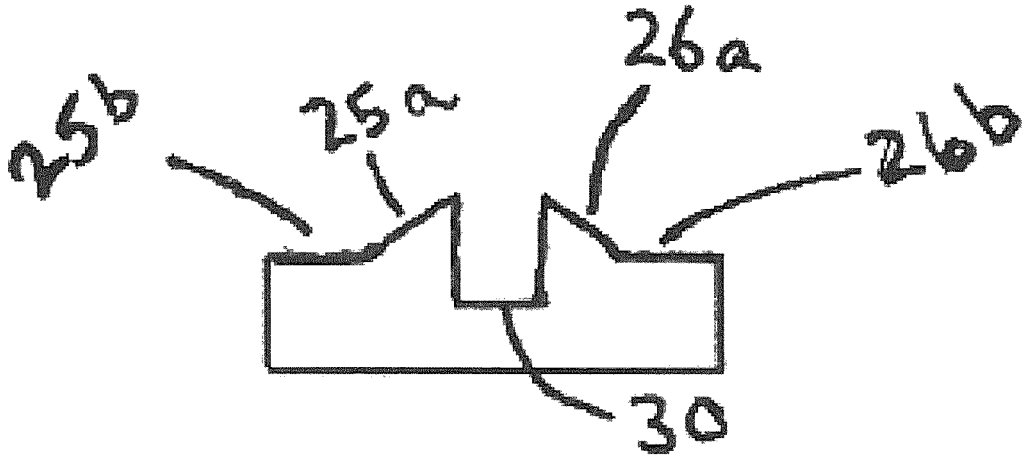
FIG. 9 is a sectional view of the die disposed on the pressing head, according to a second embodiment of the invention.

FIG. 9 shows an alternative configuration of the die disposed on the pressing head, according to a second embodiment of the invention. In contrast to FIG. 4, the first pressing surface 25*a*, 25*b* and the second pressing surface 26*a*, 26*b* are each divided into two parts. The outer parts 25*b*, 26*b* of the first and second pressing surfaces are co-planar, while the inner parts 25*a*, 26*a* are inclined relative to each other and relative to the outer parts 25*b*, 26*b*, so that the inner parts 25*a*, 26*a* protrude from the pressing surface.

In addition, FIG. 9 shows a further optional feature of the die, namely that the base 30 of the recess is located inwardly of the plane defined by the outer parts 25*b*, 26*b* of the first and second pressing surfaces.

The following worked examples are presented by way of illustration only.

EXAMPLE 1

Two gypsum boards were provided in which Board A contained silicone oil in an amount of 320 g/m$^3$, while Board B contained no silicone oil.

Board A and Board B were pressed according to the method set out in FIG. 8, and were both subjected to the same load during the step 320 in which the pressing head 16 and the support member 17 are driven towards each other.

The maximum taper depth achieved for Board A was 1.5 mm, whereas the maximum taper depth achieved for Board B was 1.0 mm (the maximum taper depth was measured after removal of the compressive force, and after drying of the board).

EXAMPLE 2

Two gypsum boards were provided in which Board C contained silicone oil in an amount of 480 g/m$^3$, while Board D contained no silicone oil.

The boards were pressed according to the method set out in FIG. 8.

The Boards were visually examined to see if blistering had occurred between the liner of the board and the underlying gypsum. The results are given in Table 1 below:

| | Board C | Board D |
|---|---|---|
| Pressed region | No blistering observed | Blistering observed |
| Unpressed region | No blistering observed | No blistering observed |

The invention claimed is:

1. A method for forming a depression within a moving, wet gypsum board, the method comprising the steps of:

providing a pressing assembly including a tapered die attached to a pressing head, the tapered die including a recess;

providing a gypsum board moving in a direction of travel at a first speed;

moving the pressing head in the direction of travel of the gypsum board, such that the speed of the pressing head in the direction of travel of the gypsum board substantially matches the first speed, while simultaneously causing the pressing head to move towards the gypsum board, to bring the recess into contact with a portion of the gypsum board, and causing the tapered die to compress the gypsum board to substantially simultaneously form a depression on either side of a comparatively uncompressed gypsum board portion.

2. A method according to claim 1, wherein the step of moving the pressing assembly in the direction of travel of the board, such that the speed of the pressing assembly in the direction of travel of the board substantially matches the speed of the board, includes adjusting the speed of the pressing assembly when there is a difference between the speed of the pressing assembly and the speed of the moving board.

3. A method according to claim 2, wherein the speed of the pressing assembly in the direction of travel of the board is matched to the speed of the board using a Hoekens linkage.

4. A method according to claim 2, wherein the speed of the pressing assembly in the direction of travel of the board is matched to the speed of the board using a hypotrochoid motion.

5. A method according to claim 1, wherein the step of causing the pressing assembly to contact and compress the board is carried out when at least 10% of the gypsum hydration has occurred.

6. A method according to claim 1, wherein the step of causing the pressing assembly to contact and compress the board is carried out when at least 40% of the gypsum hydration has occurred.

7. A method according to claim 1, wherein the gypsum board comprises silicone oil.

8. A method according to claim 7 wherein the silicone oil is present in an amount of 100-1200 $g/m^3$.

9. A method according to claim 1, wherein the step of causing the pressing assembly to contact and compress the board is carried out when at least 60% of the gypsum hydration has occurred.

10. The method as described in claim 1 wherein the recess is an aperture and the depression is formed by causing the aperture to compress against the gypsum board.

11. A method of making a gypsum board, the method comprising:

(a) imparting motion to a gypsum board in such a way that that the gypsum board translates in a first direction at a first speed;

(b) moving a pressing surface with a recess adjacent the gypsum board in the first direction and substantially at the first speed while performing (a) prior to contacting the gypsum board with the pressing surface;

(c) contacting the gypsum board with the recess of the pressing surface while moving the pressing surface in the first direction and substantially at the first speed; and (d) compressing the gypsum board with the pressing surface while performing (c), forming a depression on either side of a comparatively uncompressed portion of the gypsum board.

12. The method of claim 11, further comprising sensing the speed of the pressing surface and subsequently performing (c) when the sensed speed of the pressing surface is the first speed.

13. The method as described in claim 11 wherein the recess is an aperture and the depression is formed by causing the recess to compress against the gypsum board.

* * * * *